US007914183B2

(12) United States Patent
Yang et al.

(10) Patent No.: US 7,914,183 B2
(45) Date of Patent: Mar. 29, 2011

(54) LED LAMP HAVING ELASTIC MEMBERS FOR SECURING LED MODULE TO HEAT SINK THEREOF

(75) Inventors: Ri-Lang Yang, Shenzhen (CN); Guang Yu, Shenzhen (CN)

(73) Assignees: Fu Zhun Precision Industry (Shen Zhen) Co., Ltd., Shenzhen, Guangdong Province (CN); Foxconn Technology Co., Ltd., Tucheng, Taipei County (TW)

( * ) Notice: Subject to any disclaimer, the term of this patent is extended or adjusted under 35 U.S.C. 154(b) by 235 days.

(21) Appl. No.: 12/324,855

(22) Filed: Nov. 27, 2008

(65) Prior Publication Data

US 2009/0323340 A1 Dec. 31, 2009

(30) Foreign Application Priority Data

Jun. 27, 2008 (CN) ..... 2008 1 0068060

(51) Int. Cl.
*F21V 29/00* (2006.01)
*F21V 21/00* (2006.01)

(52) U.S. Cl. ..... 362/373; 362/249.02

(58) Field of Classification Search ..... 362/294, 362/345, 373, 249.02
See application file for complete search history.

(56) References Cited

U.S. PATENT DOCUMENTS

| | | | | |
|---|---|---|---|---|
| 5,390,093 | A * | 2/1995 | Himeno et al. | 362/294 |
| 5,491,619 | A * | 2/1996 | Gill | 362/294 |
| 6,565,239 | B2 * | 5/2003 | Rizkin et al. | 362/373 |
| 6,568,833 | B2 * | 5/2003 | Worgan et al. | 362/294 |
| 6,850,411 | B1 * | 2/2005 | Patel | 361/704 |
| 7,549,772 | B2 * | 6/2009 | Wang | 362/294 |

* cited by examiner

*Primary Examiner* — Alan Cariaso
(74) *Attorney, Agent, or Firm* — Frank R. Niranjan

(57) ABSTRACT

An LED lamp includes an LED module, a heat sink having a base abutting an upside of the LED module, a plurality of posts extending through the LED module and into the base of the heat sink, and a plurality of elastic members engaging the plurality of posts respectively and elastically abutting an underside of the LED module to secure the LED module to the base of the heat sink. The LED module is sandwiched between the base and the elastic members, and is thereby secured to the base of the heat sink.

16 Claims, 6 Drawing Sheets

LED LAMP HAVING ELASTIC MEMBERS FOR SECURING LED MODULE TO HEAT SINK THEREOF

BACKGROUND OF THE DISCLOSURE

1. Field of the Disclosure

The present disclosure relates to an LED lamp, and particularly to an LED lamp having an LED module readily secured to a heat sink of the LED lamp.

2. Description of Related Art

An LED lamp is a type of solid-state lighting device that utilizes light-emitting diodes (LEDs) as a source of illumination. The LED has an advantage of being resistant to shock, and an almost unlimited lifetime under specific conditions, making it a cost-effective yet high quality replacement for incandescent and fluorescent lamps. Conventionally, the LED lamp utilizes a heat sink to dissipate heat generated by the LED module. The LED module is directly secured to the heat sink by a mounting device such as a plurality of fasteners. The assembly of the plurality of the fasteners is the source of some difficulty, since the fasteners may drop from the LED module during assembly, a problem that is aggravated when the LED lamp is deployed outdoors and at heights, such as when the LED lamp is a highway lamp.

What is needed, therefore, is an improved LED lamp which can overcome the described limitations.

SUMMARY OF THE DISCLOSURE

An LED lamp includes an LED module, a heat sink having a base abutting an upside of the LED module, a plurality of posts extending through the LED module and into the base of the heat sink, and a plurality of elastic members engaging the plurality of posts respectively and elastically abutting an underside of the LED module to secure the LED module to the base of the heat sink. The LED module is sandwiched between the base and the elastic members.

Other advantages and novel features will become more apparent from the following detailed description of preferred embodiments when taken in conjunction with the accompanying drawings.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION OF THE DISCLOSURE

Figure 1:
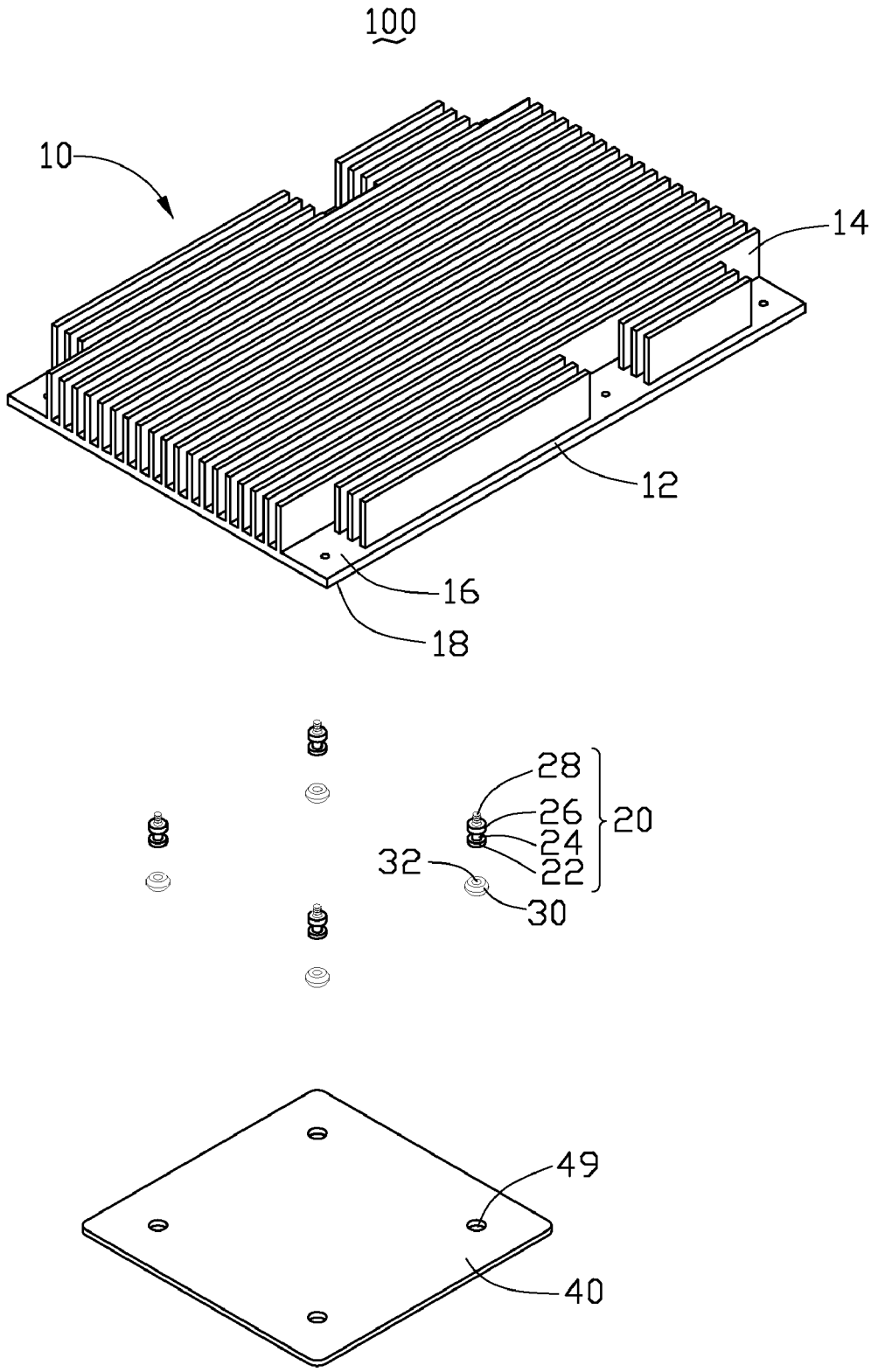
FIG. 1 is an isometric, exploded view of an LED lamp in accordance with a preferred embodiment of the present disclosure.
Figure 2:
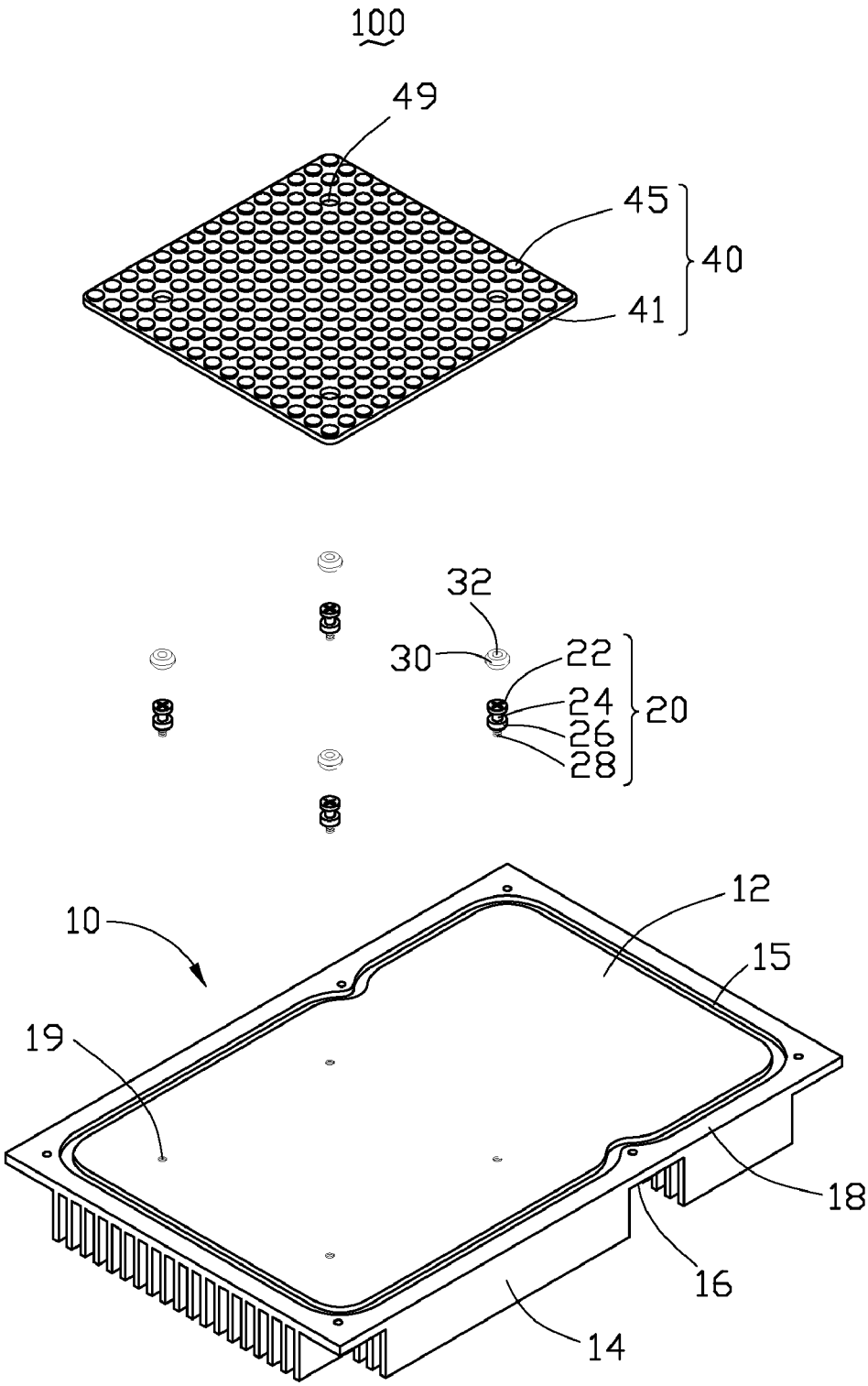
FIG. 2 is an inverted view of the LED lamp in FIG. 1.

Referring to FIGS. 1-2, an LED lamp 100 in accordance with a present embodiment is illustrated. The LED lamp 100 comprises a heat sink 10, an LED module 40 located on the heat sink 10, and a mounting device (not labeled) securing the LED module 40 to the heat sink 10. The mounting device includes four posts 20 engaging the heat sink 10 and extending through the LED module 40, and four elastic members 30 mounted on the posts 20. The LED module 40 is sandwiched between the heat sink 10 and the elastic members 30.

Figure 3:
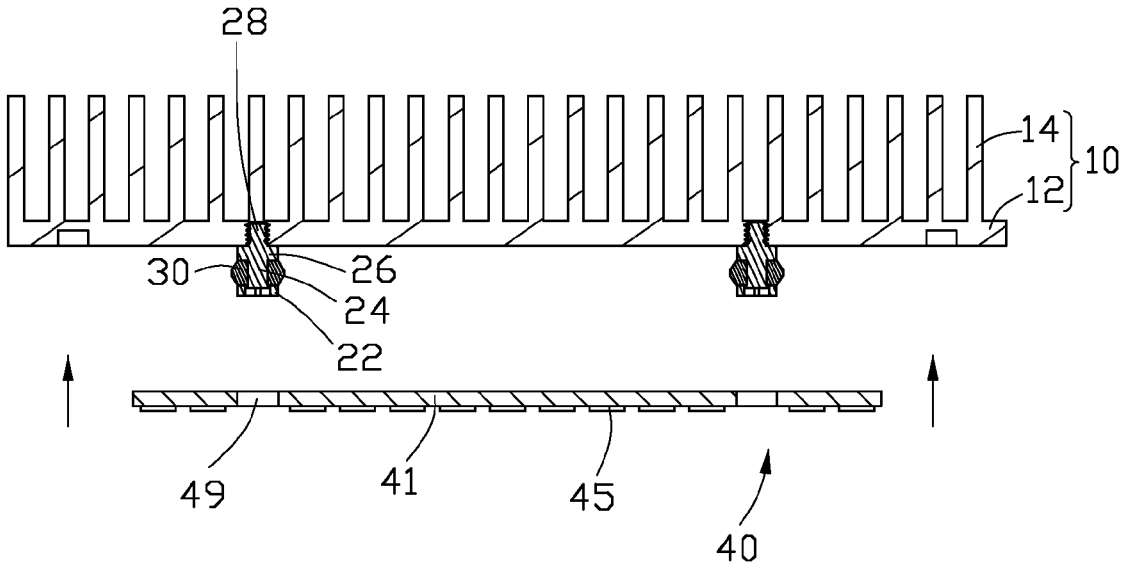
FIG. 3 is a cross-section of the LED lamp in FIG. 1, showing posts and elastic members engaging a heat sink of the LED lamp.
Figure 4:
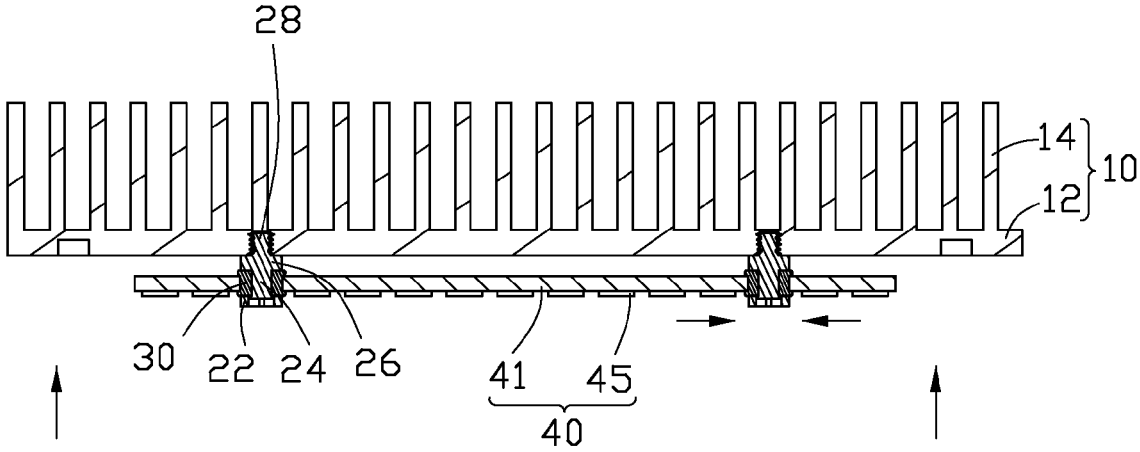
FIG. 4 is a view similar to FIG. 3, but shows the LED module disposed among the posts and the elastic members.
Figure 5:
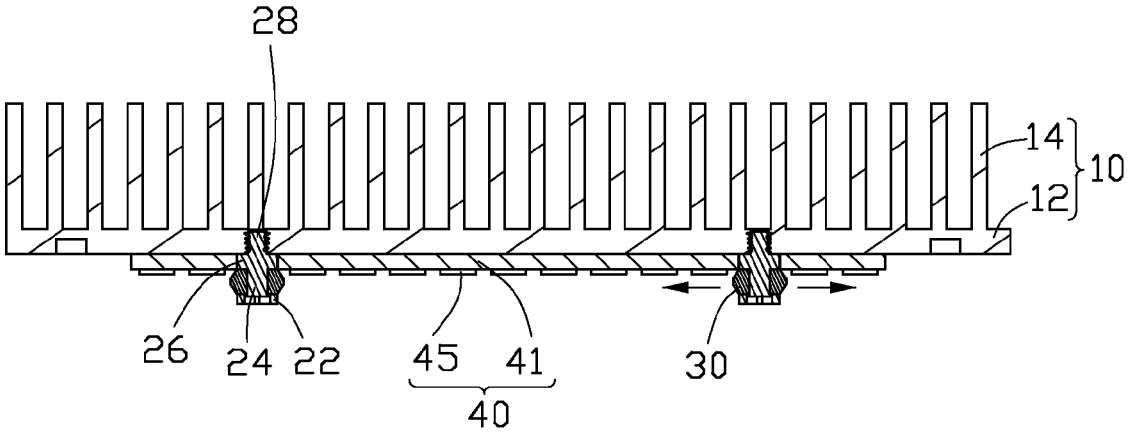
FIG. 5 is a view similar to FIG. 3, but shows the LED module and the posts combined together by the elastic members.
Figure 6:
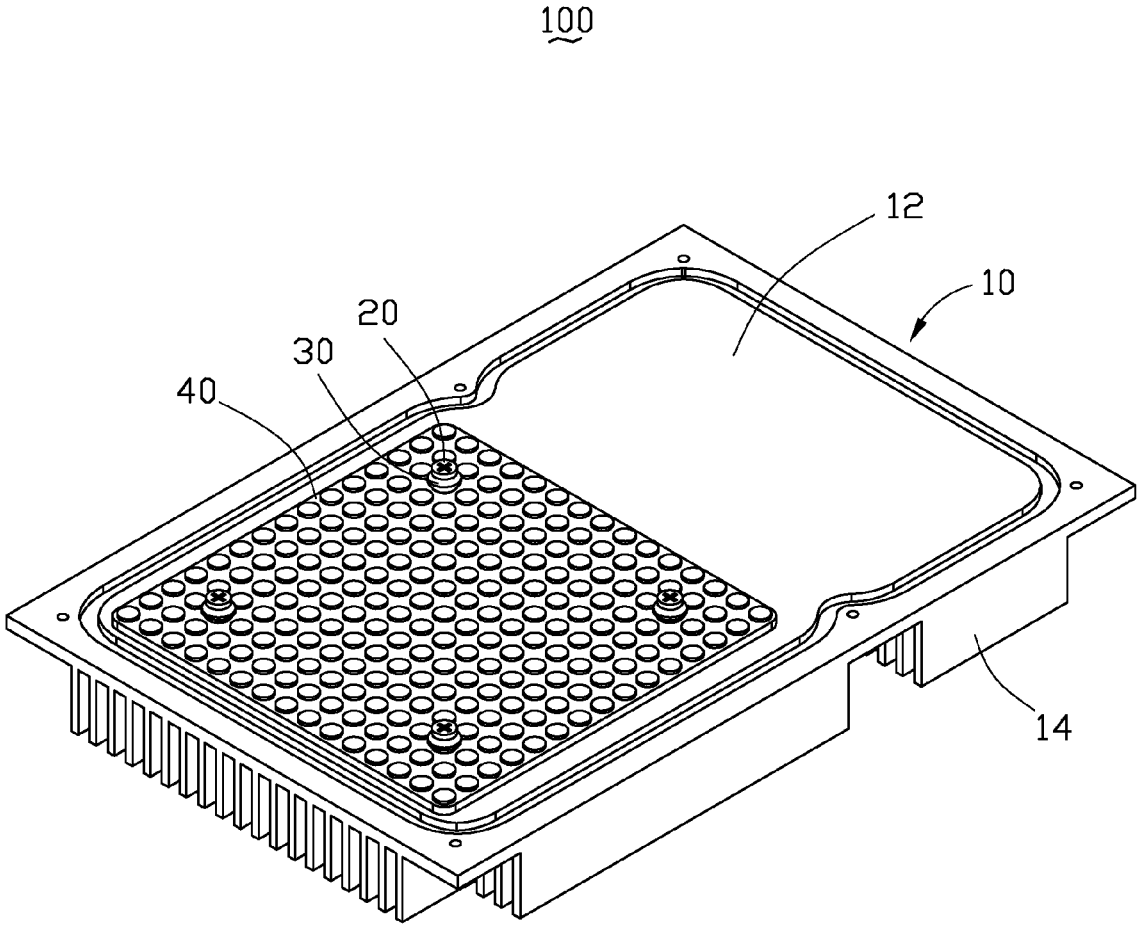
FIG. 6 is an assembled view of the LED lamp in FIG. 2.

Also referring to FIG. 3, the heat sink 10 comprises a rectangular base 12 and a plurality of fins 14 extending therefrom. The base 12 has a top surface 16 and a bottom surface 18 opposite thereto. The fins 14 extend parallel and upwardly from the top surface 16 of the base 12. A rectangular recess 15 is defined in the bottom surface 18 of the base 12 and adjoins edges of the base 12, for receiving a waterproof cushion (not shown) therein, whereby a transparent/translucent cover (not shown) of the LED lamp 100 can be hermetically mounted to the bottom surface of the base 12 to protect the LED module 40 therein. The base 12 defines four fastener holes 19 in the bottom surface 18 thereof engaging the posts 20. The four fastener holes 19 are within the recess 15.

Each of the posts 20 comprises a head portion 22, a neck portion 24, a pole portion 26, and a threaded portion 28 extending from the pole portion 26. The head portion 22, the neck portion 24, the pole portion 26 and the threaded portion 28 align on a same longitudinal axis. The neck portion 24 extends from the head portion 22 and has a diameter less than that of the head portion 22. The pole portion 26 extends from the neck portion 24 and has the same diameter as the head portion 22. The threaded portion 28 forms a spiral thread on an outer wall thereof. Each of the threaded portions 28 engages each of the fastener holes 19 of the base 12 so that the posts 20 are secured to the heat sink 10. Due to the diameter of the neck portion 24 being less than that of the head portion 22 and the pole portion 26, a round recess is defined around an outer surface of the neck portion 24, receiving the elastic member 30.

Each elastic member 30 is of an elastic material such as rubber. In this embodiment, each elastic member 30 is a rubber ring with a central hole 32 defined therein. A thickness of each elastic member 30 is similar to a length of the neck portion 24 along the axial direction thereof. Outer diameters of each elastic member 30 gradually decrease along the axial direction from a middle portion thereof to two ends of the elastic member 30. Thus, the elastic member 30 has a convex outer circumferential surface. In an original shape, an inner diameter of each elastic member 30 (i.e., a diameter of the central hole 32) is smaller than the diameter of the head portion 22; and the outer diameter of each end of the elastic member 30 is the same as the diameter of the head portion 22, whereby the outer diameter of middle portion of the elastic member 30 is larger than that of the head portion 22. The elastic member 30 can be elastically expanded in a radial direction when an expanding force in the radial direction is applied thereto, so that the head portions 22 of the posts 20 are able to extend through the central holes 32 of the elastic members 30, whereby the neck portions 24 of the posts 20 engage in the central holes 32, respectively.

The LED module 40 comprises a substantially square circuit board 41 and a plurality of LEDs 45 arranged on an underside (not labeled) of the circuit board 41 in a matrix. Corresponding to the four fastener holes 19 in the base 12, four through holes 49 are defined in the circuit board 41. Each of the through holes 49 has an inner diameter slightly larger than the diameter of the head portion 22 of each post 20 and smaller than the outer diameter of the middle portion of the elastic member 30.

As shown in FIGS. 3-6, in assembly of the LED lamp 100, each of the elastic members 30 is mounted to the neck portion 24 of each post 20 via the head portion 22 extending through the central hole 32 of the elastic member 30. The elastic member 30 is received in the recess of the post 20 and two ends thereof abut the head portion 22 and the pole portion 26, respectively. The threaded portion 28 of each of the posts 20 engages the fastener hole 19 of the base 12 with the pole portion 26 abutting the base 12. The LED module 40 is mounted to the posts 20 engaged in the base 12 with the through holes 49 of the circuit board 41 correspondingly sleeving the head portions 22 of each post 20. Each of the elastic members 30 is pressed by the circuit board 41 of the LED module 40 and has an inwardly elastic deformation to extend through the through holes 49 of the circuit board 41. The circuit board 41 of the LED module 40 is impelled to engage the pole portions 26 of the posts 20, and releases the elastic members 30 to resume the original shape. The base 12 abuts an upside of the circuit board 41 of the LED module 40 and the elastic members 30 elastically abut an underside of the LED module, whereby the circuit board 41 of the LED module 40 is securely sandwiched between the base 12 and the elastic members 30. Accordingly, the circuit board 41 of the LED module 40 is securely attached to the base 12 of the heat sink 10 by the elastic members 30.

In disassembly of the LED lamp 100, the LED module 40 is directly withdrawn from base 12 of the heat sink and passes through the posts 20 and the elastic members 30 via the elastic deformation of the elastic members 30. Additionally, since the posts 20 with the elastic members 30 are pre-assembled to the base 12 of the heat sink 10, assembly the LED module 40 to the heat sink 10 is convenient.

It is believed that the present embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. An LED lamp comprising:

an LED module;

a heat sink comprising a base abutting an upside of the LED module;

a plurality of posts extending through the LED module and into the base of the heat sink; and a plurality of elastic members engaging the plurality of posts respectively and elastically abutting an underside of the LED module to secure the LED module to the base of the heat sink;

wherein each post comprises a head portion, a neck portion extending from the head portion, a pole portion extending from the neck portion and a threaded portion extending from the pole portion; and wherein the neck portion has a diameter less than a diameter of the head portion and less than a diameter of the pole portion.

2. The LED lamp as claimed in claim 1, wherein the elastic members are rubber rings.

3. The LED lamp as claimed in claim 1, wherein the threaded portion defines spiral threads on an outer wall thereof and is engaged in the base of the heat sink.

4. The LED lamp as claimed in claim 1, wherein the elastic members surround the neck portions of the posts and abut the underside of the LED module.

5. The LED lamp as claimed in claim 4, wherein each of the elastic members defines a central hole and outer diameters thereof gradually decrease along an axial direction from a middle portion thereof to two ends thereof.

6. The LED lamp as claimed in claim 5, wherein the outer diameter of the middle portion of the elastic member in an original shape is larger than that of the head portion of each post.

7. The LED lamp as claimed in claim 1, wherein the LED module comprises a circuit board and a plurality of LEDs arranged on an underside of the circuit board, and wherein a plurality of holes is defined in the circuit board through which the posts extend.

8. An LED lamp comprising:

an LED module comprising a circuit board and a plurality of LEDs arranged on the circuit board;

a heat sink;

a plurality of posts each comprising a head portion, a neck portion extending from the head portion, a pole portion extending from the neck portion, and a threaded portion extending from the pole portion threadedly engaging the heat sink; and a plurality of elastic members engaging the neck portions of the posts;

wherein the circuit board of the LED module engages the pole portions of the posts and is sandwiched between the heat sink and the elastic members; and wherein the neck portion has a diameter less than a diameter of the head portion and less than a diameter of the pole portion.

9. The LED lamp as claimed in claim 8, wherein each of the elastic members is annular.

10. The LED lamp as claimed in claim 8, wherein each of the elastic members has an outer diameter larger than a diameter of the pole portion of each of the posts when the elastic members are in an original shape.

11. The LED lamp as claimed in claim 10, wherein the circuit board defines a plurality of holes through which the posts extend, and each of the holes has a diameter less than the outer diameter of each elastic member.

12. An LED lamp comprising:

an LED module;

a heat sink comprising a base abutting an upside of the LED module;

a plurality of posts extending through the LED module and into the base of the heat sink; and a plurality of elastic members engaging the plurality of posts respectively and elastically abutting an underside of the LED module to secure the LED module to the base of the heat sink;

wherein each post comprises a head portion, a neck portion extending from the head portion, a pole portion extending from the neck portion and a threaded portion extending from the pole portion;

wherein the elastic members surround the neck portions of the posts and abut the underside of the LED module; and wherein each of the elastic members defines a central hole and outer diameters thereof gradually decrease along an axial direction from a middle portion thereof to two ends thereof.

13. The LED lamp as claimed in claim 12, wherein the elastic members are rubber rings.

14. The LED lamp as claimed in claim 12, wherein the threaded portion defines spiral threads on an outer wall thereof and is engaged in the base of the heat sink.

15. The LED lamp as claimed in claim 12, wherein the outer diameter of the middle portion of the elastic member in an original shape is larger than that of the head portion of each post.

16. The LED lamp as claimed in claim 12, wherein the LED module comprises a circuit board and a plurality of LEDs arranged on an underside of the circuit board, and wherein a plurality of holes is defined in the circuit board through which the posts extend.

* * * * *